US006880896B2

(12) United States Patent
Stein et al.

(10) Patent No.: US 6,880,896 B2
(45) Date of Patent: Apr. 19, 2005

(54) DEVICE FOR MANUFACTURING BRUSH PRODUCTS

(75) Inventors: Bernd Stein, Schmitten (DE); Bryan Flood, Iowa City, IA (US)

(73) Assignee: Braun GmbH, Kronberg ( * ) Notice: Subject to any disclaimer, the term of this patent is extended or adjusted under 35 U.S.C. 154(b) by 326 days.

(21) Appl. No.: 10/236,130

(22) Filed: Sep. 6, 2002

(65) Prior Publication Data

US 2003/0071512 A1 Apr. 17, 2003

(30) Foreign Application Priority Data

Oct. 12, 2001 (DE) ..... 101 50 576

(51) Int. Cl.[7] ..... A46D 1/08
(52) U.S. Cl. ..... 300/7; 300/2
(58) Field of Search ..... 300/2, 7

(56) References Cited

U.S. PATENT DOCUMENTS

| | | | | | |
|---|---|---|---|---|---|
| 340,184 | A | * | 4/1886 | Young | 300/7 |
| 521,630 | A | * | 6/1894 | Besson | 300/7 |
| 1,070,861 | A | * | 8/1913 | Vanderveld | 300/7 |
| 3,367,719 | A | * | 2/1968 | Carlson | 300/7 |
| 4,733,917 | A | * | 3/1988 | Boucherie | 300/7 |
| 6,079,788 | A | * | 6/2000 | Boucherie | 300/7 |
| 6,145,935 | A | | 11/2000 | Boucherie | |

FOREIGN PATENT DOCUMENTS

| | | |
|---|---|---|
| DE | 86012 | 3/1896 |
| DE | 1028969 | 4/1958 |
| DE | 1632367 | 11/1970 |
| DE | 1938937 | 2/1971 |
| DE | 19734615 A1 | 9/1998 |
| DE | 19808883 C1 | 10/1999 |
| EP | 0 972 465 A1 | 1/2000 |

* cited by examiner

*Primary Examiner*—Randall Chin
(74) *Attorney, Agent, or Firm*—Fish & Richardson P.C.

(57) ABSTRACT

A device for manufacturing brush products, in particular toothbrushes, with a bristle magazine having a feed chute for receiving filaments of precut length arranged in a dense array transverse to the longitudinal axis of the bristle magazine. The feed chute has a discharge opening which is bounded by a bristle picker closing the discharge opening from outside, and serves to feed filaments to a recess provided on the bristle picker. The recess receives only a predetermined quantity of filaments, combining them into tufts which are then transferred to further stations for further processing. According to the invention, the feed chute has a magazine bottom on which the discharge opening is formed. The magazine bottom is further shaped in an arcuate configuration tapering essentially in the direction of the discharge opening. This produces a steady filament flow in which dead zones are not allowed to develop.

32 Claims, 2 Drawing Sheets

DEVICE FOR MANUFACTURING BRUSH PRODUCTS

CROSS-REFERENCE TO RELATED APPLICATION

This application claims the benefit of German application serial number 101 50 576.0 filed Oct. 12, 2001.

TECHNICAL FIELD

This invention relates to a device for manufacturing brush products, particularly to toothbrushes.

BACKGROUND

The art knows of devices for the manufacture of brush products, in particular toothbrushes. Thus, for example, DE-1 028 969 A1 describes a device for feeding bristle tufts in brush manufacturing machines. The tufting device described therein includes a bristle picker which separates a small cluster of bristles from a major supply of bristles in a bristle magazine and transfers it to the tufting tool which anchors the tuft in the brush body together with a fastening anchor or a cramp. The separating of small bristle clusters or tufts is accomplished by providing the picker with a recess which sweeps along the bristle magazine, the recess being filled with bristles from the magazine during this process.

Furthermore, DE-1 938 937 A1 describes a method for manufacturing brushes having in each tuft at least two types of bristle, each type of bristle being supplied separate from the other type, and wherein during a feeding operation the bristles are withdrawn from a magazine and transferred to a tufting tool of a brush manufacturing machine. According to this specification, provision is made for two bristle magazines rectangular in cross section, with suitable bristle pickers sweeping across the magazines' lower ends to pick up the desired bristle clusters.

A solution similar to the one described in DE-1 938 937 A1 for feeding bristles is disclosed in DE-197 34 615 A1. It describes a method and a device for manufacturing a toothbrush bristle carrier equipped with a plurality of bristle tufts.

Finally, DE-1 632 367 A1 discloses a device for feeding bristles or filament bundles to a brush manufacturing machine, said device being also referred to as bristle magazine. The bristle magazine is essentially quadrangular in cross section. The smooth side walls have in their middle region on one side a curvature causing the cross section to taper to form a rectangle with a reduced base area. This area of reduced cross section amounts to about one third of the overall length of the bristle magazine. To effect bristle flow, a hydraulic press acts upon a pusher at the upper end of the bristle magazine. In addition, a conveyor chain is arranged in the bottom area parallel to the longitudinal axis in an attempt to achieve a steady bristle flow. At the lower end a bristle picker picks up the desired number of bristles, transfer ring them to the brush holder.

A schematic representation of the filament flow in the devices known in the art is given in FIG. 2. In this Figure, reference numeral 1 designates the filament feed unit or the bristle magazine. The bristle magazine 1 is of square cross section, having rectangular guide walls 2 as its lateral boundaries. Filaments 4 of precut length are arranged within the rectangular guide walls 2. Arranged at the upper end of the bristle magazine 1 as seen looking in the plane of the drawing is a pusher 3 to which a hydraulic force is applied in the direction of arrow A. It operates to urge the filaments 4 in a downward direction.

Arranged at the lower end of the bristle magazine 1 of FIG. 2 is a bristle picker 6 which is displaceable in a direction perpendicular to the longitudinal axis of the bristle magazine 1. The bristle picker 6 is also designated as picker tooling or picker bar. In operation, the bristle picker 6 moves forward and backward alternately in the directions of arrows B. On its side close to the bristle magazine 1, the bristle picker 6 has recesses 7 for receiving bristles or filaments 11, said recesses 7 being also designated as "tuft eyes". The filaments 11 received in the recesses 7 form individual bristle tufts intended for fastening to a toothbrush head in a later processing step. Because the bristle clusters are picked up non-symmetrically, the bristle magazine 1 develops dead zones 5 which are also referred to as filament bridging and interrupt the filament flow.

Furthermore, EP-0 972 465 A1 describes a device for manufacturing bristle products of the type initially referred to. As in all the other citations identified, the bristle magazine has at its dispensing end a discharge opening corresponding to the cross section of the bristle magazine, which is closed by the bristle picker. In the citation referred to, the bristle picker is a crescentshaped slide rotary about an axis and having on its closing surface facing the discharge opening one or several recesses for receiving filaments. Here, too, dead zones of the type mentioned in the foregoing develop in the corners of the bristle magazine close to the discharge opening, which interrupt the filament flow.

SUMMARY

Improvements are desired to develop a continuous filament flow. Dead zones and non-uniformity in the number of filaments per tuft can be caused by a non-symmetrical picking of the filament clusters. Filament flow can be interrupted by effects referred to as bridging or arching. Arching or bridging is understood to be an apparent compacting of the bristle clusters whereby solid body flow is inhibited and can have an adverse effect on process safety and product quality.

It is an object of the present invention to provide an improved device for manufacturing brushes. In particular, the device is intended to enable the low-cost manufacturing of brush products at a high level of process safety and product quality.

This object is accomplished by a device for manufacturing brush products, in particular toothbrushes, with a feed unit for precut lengths of bristle clusters arranged loosely in a feed chute. The feed chute, a part of a bristle magazine, is bordered by guide walls for receiving the filaments which are arranged in a dense array parallel to the guide walls. The guide walls of the feed chute are shaped in arcuate configurations tapering essentially in the direction of a discharge opening. The discharge opening is bounded by a bristle picker which closes the discharge opening from outside and serves to feed the filaments to a recess provided on the bristle picker. The recess receives only a predetermined quantity of filaments, combining them into tufts which are then transferred to further stations for further processing.

Some embodiment include the arcuate configurations forming the bottom of the feed chute, those arcuate configurations being essentially circular or parabolic in longitudinal cross section. Being suitably configured, the discharge area produces a symmetrical and particularly steady flow of filaments or bristles. To this effect, the bottom of the magazine is of a cup-shaped configuration having preferably a spherical or ellipsoidal surface or similarly homogenous design.

In another embodiment, the discharge opening is arranged centrally to the feed chute and the arcuate configurations extend symmetrically to a longitudinal axis of the feed chute. This embodiment better ensures that the bristle picker picks the filaments symmetrically from the middle of the chute. Additional features or embodiments may include discharge openings with variable orifice cross section.

In some cases, the discharge opening is, on the one hand, shaped to conform to the size of the bristle tufts to be picked up by the bristle picker and, on the other hand, is formed at a lowest position of the bristle magazine.

The configuration of the bristle magazine of the invention can avoid dead zones in which a continuous filament flow is prevented from developing. The forces acting normal to the arcuately shaped discharge end and resulting from the force or pressure of the pusher operate to support the splitting of inter-filament bridges, avoiding effects known under the terms arching and bridging. Furthermore, the removal of interferences in the filament bed is expedited, hence assuring an increased product quality, that is, sections in the filament feed chute in which filaments have lost their upright orientation due to external influence, are pushed out of the filament chute more quickly. This results in a reduced susceptibility to trouble and enhances process safety. In addition, it enables the filaments to be picked up symmetrically from the middle of the chute. A higher constancy in the number of filaments entering the recesses of the bristle picker on each operating cycle is furthermore achieved.

Another advantageous effect is a reduced dependence upon the filament finish level. This means that the supply of bristle clusters is independent of the filament manufacturing process and the filament type while process safety is maintained at a consistently high level. This also enables processing of filaments proceeding at a very slow rate. This becomes apparent, for example, from the smooth processing of particularly fine filaments with a diameter less than, for instance, 5 mils (1 mil=1/6400 of the circumference of a circle). The device hence assures increased product quality, enhanced process safety, and greater output. With the device it is furthermore possible to supply the requisite number of filaments per picker stroke.

The terms bristle picker, picker segment or picker tooling are used to designate a tool for picking up the tufts in a tufting machine and subsequently transferring them to their destination on the bristle carrier. In cases where filaments of precut length are employed, the term cut tuft technology is also used.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
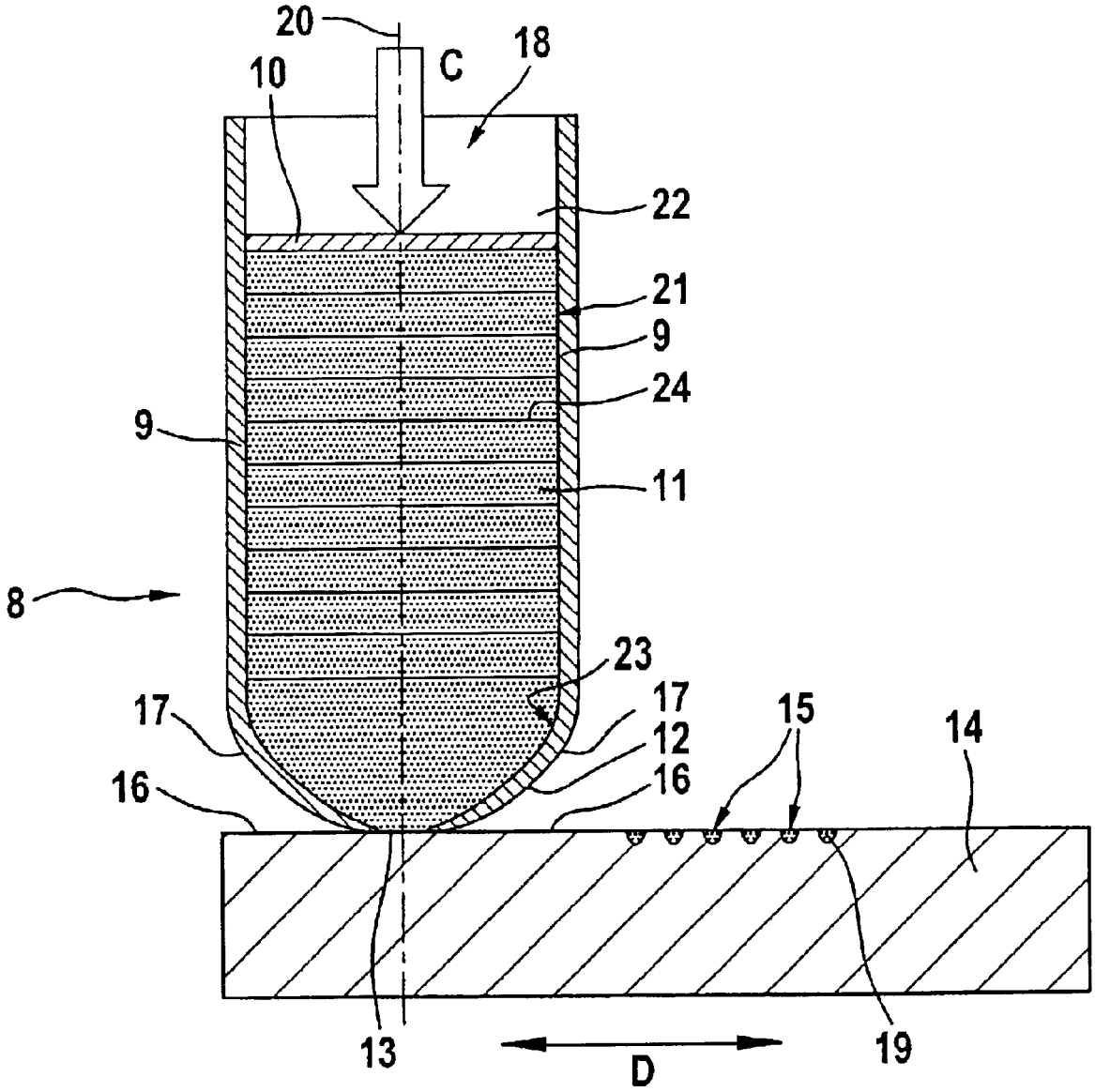
FIG. 1 is a schematic sectional view of an embodiment of a feed unit constructed in accordance with the present invention.
Figure 2:
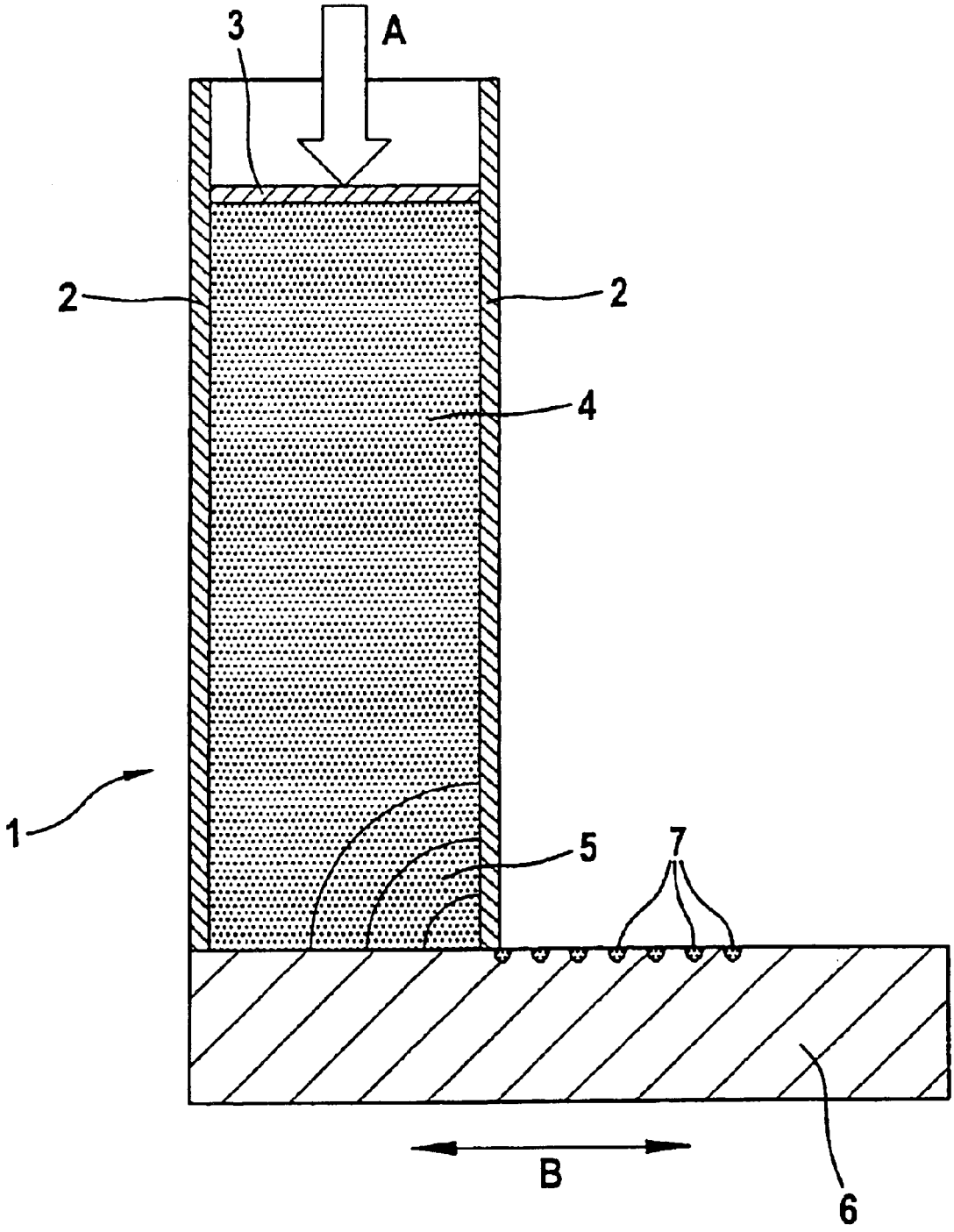
Fig. 2 PRIOR ART
FIG. 2 is a schematic view of a conventional feed unit as known from the art.

FIG. 1 shows a feed unit, hereinafter referred to as bristle magazine 8, which finds application in a brush manufacturing machine not shown. The bristle magazine 8 is preferably of rectangular cross section. Other cross sections may also be contemplated however. In the present embodiment, the sides of the elongate bristle magazine 8 are formed by rectangular guide walls 9 which are made from sheet steel and joined to each other, preferably by welding where metal is concerned. Arranged in the receiving chamber 22 of the bristle magazine 8 at the upper end thereof, as seen looking in the plane of the drawing, is a pusher 10 which is subjected to pressure in the direction of arrow C. The pusher 10 rests on an aggregate 21 of filaments cut to a predetermined length. The aggregate 21 of filaments comprises a plurality of individual, very thin bristles or filaments 11 preferably extruded from plastics, which extend parallel to the pusher 10 and the guide walls 9, lie in very close proximity to each other and are all of equal length. In addition, provision is made for suitable guiding elements (not shown) in the transition region from the pusher 10 to the guide walls 9 to prevent jamming of the pusher 10 in the receiving chamber 22 of the bristle magazine 8. In the present embodiment, the pressure force C is applied by a hydraulic cylinder, not shown, to the pusher 10 which is preferably manufactured from sheet steel or plastics.

The bristle magazine 8 has at its lower end guide walls 9 which, according to the invention, are circular-arc shaped, with a dome towards its center, and which form the magazine bottom 17. Preferably, part of the guide walls 9 of the magazine bottom 17 is made from drawn sheet steel. It will be understood, of course, that it is also possible for the the upper ends of the magazine bottom 17 to be joined to the guide walls 9 by welding. The transition region 23 between the magazine bottom 17 and the guide wall 9 is of a smooth, polished configuration to ensure an unimpeded flow of the filaments 11. This is still increased by the fact that in the range of the transition region 23 towards the discharge opening 13 the guide wall 9 uniformly tapers resulting in that, at the discharge opening, the thickness of the guide wall 9 is very thin, so that practically no step and thus no jamming of the filaments 4 can occur. It will be understood, of course, that it is also possible for the bristle magazine 8 to be deep-drawn in one integral piece. The bottom 17 of the bristle magazine 8 is of an essentially cup-shaped configuration, having at its bottonimost point a discharge opening 13 arranged at a very narrow distance to the upper side 16 of the bristle picker 14 to prevent filaments 11 from escaping when the bristle picker 14 sweeps across the opening. The discharge opening 13 has an orifice dimensioned sufficiently large for the recesses 15 formed in the bristle picker 14 to be filled with filaments 11 to capacity when the picker sweeps across the opening. The size of the recesses 15 corresponds to the desired size of the bristle tufts.

In the present embodiment the discharge opening 13 may be of the adjustable type, hence enabling different sizes of bristle tuft to be obtained with the same magazine, yet with a different bristle picker 14. In the present embodiment the adjustment mechanism (not shown) can be realized by using slidable sheets for the magazine bottom 17, which sheets open a larger or a smaller gap through which a correspondingly greater or smaller number of filaments 11 is allowed to exit from the bristle magazine 8.

The bristle picker 14 is arranged underneath the discharge opening 13 at right angles to the longitudinal axis 20 of the bristle magazine 8. In this arrangement the bristle picker 14 is substantially a rectangular solid structure having on its upper side 16 one or several groove-shaped recesses 15 arranged in succession to receive filaments 11 which form tufts 19 when the recesses 15 are filled to capacity. The recess or recesses 15 extend(s) parallel to the filaments 11 arranged in the feed chute 18, which filaments, in turn, are aligned perpendicular to the plane of the drawing or, in other terms, perpendicular to the longitudinal axis 20 of the feed chute 18. The bristle picker 14 may also be configured in the manner of the arc of a circle, thus performing, instead of a reciprocating motion, a rotary motion in which it receives in its recess(es) 15 many filaments 11 for the formation of individual bristle tufts 19 (not shown).

For operation, the pusher 10 is first removed to fill the bristle magazine 8 with bristles or filaments 11 of precut length. As shown in FIG. 1, during loading, the discharge opening 13, which may also be of a circular-arc-shaped configuration, is covered by the horizontally extending flat upper side 16 of the bristle picker 14, thereby preventing the escape of bristles from the bristle magazine 8. Then the pusher 10 is put back in place, like a movable magazine lid, and connected to a hydraulic lever of a hydraulic cylinder (not shown). The application of a uniform pressure to the pusher 10 in the direction of arrow C and the reciprocating movement of the bristle picker 14 in the directions of arrows D, or, in cases where a rotary bristle picker (not shown) is used, the rotary movement thereof, cause a steady filament flow to be set in motion. The filaments 11 move as one block in the upper section, which is indicated by the horizontal lines 24 in the bristle magazine of FIG. 1. In the radiused magazine bottom 17 the filaments 11 flow in a symmetrical array. This prevents the development of dead zones in which no continuous filament flow takes place. The forces acting normal to the radius of curvature and resulting from the force or pressure exerted by the pusher operate to support the splitting of interfilament bridges, preventing effects known as arching and bridging from occurring. The bristle picker 14 picks up the filaments 11 which are forcibly urged into the recesses 15. As this occurs, filaments 11 move up to the discharge opening 13 from all sides in a steady flow.

A number of embodiments of the invention have been described. Nevertheless, it will be understood that various modifications may be made without departing from the spirit and scope of the invention. Accordingly, other embodiments are within the scope of the following claims.

What is claimed is:

1. A device for manufacturing brushes comprising:

a bristle magazine having a feed chute comprised of guide walls for receiving filaments of precut length arranged in an array parallel to the guide walls, the feed chute having a discharge opening which is formed by the guide walls wherein the guide walls form arcuate shapes and taper essentially in the direction of the discharge opening; and a bristle picker bounding the discharge opening from outside, the bristle picker having at least one recess for receiving a predetermined quantity of the filaments;

wherein the arcuate shapes form a magazine bottom of the feed chute and are essentially circular in longitudinal cross section.

2. The device according to claim 1, wherein the guide walls are comprised of drawn sheet steel.

3. The device according to claim 1, wherein the guide walls have a finished inner surface.

4. The device according to claim 1, wherein the arcuate shapes terminate at the discharge opening.

5. The device according to claim 1, wherein the discharge opening is arranged centrally to the feed chute and the arcuate shapes extend symmetrically to a longitudinal axis of the feed chute.

6. The device according to claim 1, wherein the discharge opening defines an orifice of variable cross section.

7. The device according to claim 6, wherein the orifice of variable cross section is defined between slideable sheets.

8. The device according to claim 1, wherein the discharge opening is shaped to conform to the size of the bristle tufts to be picked up by the bristle picker and is formed at a lowest position of the bristle magazine.

9. The device according to claim 1, wherein the at least one recess is groove-shaped.

10. The device according to claim 9, wherein the at least one recess extends parallel to the filaments.

11. The device according to claim 1, wherein the arcuate shapes of the guide walls are symmetrical along the longitudinal axis of the feed chute.

12. The device according to claim 1, wherein the bristle picker is configured in a circular design.

13. The device according to claim 12, wherein the bristle picker rotates around an axis.

14. The device according to claim 1, wherein the bristle magazine includes a pusher adapted to apply pressure to a quantity of the filaments within the bristle magazine.

15. A device for manufacturing brushes comprising:

a bristle magazine having a feed chute comprised of guide walls for receiving filaments of precut length arranged in an array parallel to the guide walls, the feed chute having a discharge opening which is formed by the guide walls wherein the guide walls form arcuate shapes and taper essentially in the direction of the discharge opening; and a bristle picker bounding the discharge opening from outside, the bristle picker having at least one recess for receiving a predetermined quantity of the filaments;

wherein the arcuate shapes form a magazine bottom of the feed chute and are essentially parabolic in longitudinal cross section.

16. The device according to claim 15, wherein the arcuate shapes terminate at the discharge opening.

17. The device according to claim 15, wherein the discharge opening is arranged centrally to the feed chute and the arcuate shapes extend symmetrically to a longitudinal axis of the feed chute.

18. The device according to claim 15, wherein the discharge opening defines an orifice of variable cross section.

19. The device according to claim 15, wherein the discharge opening is shaped to conform to the size of the bristle tufts to be picked up by the bristle picker and is formed at a lowest position of the bristle magazine.

20. The device according to claim 15, wherein the at least one recess is groove-shaped.

21. The device according to claim 15, wherein the bristle picker is configured in a circular design.

22. The device according to claim 21, wherein the bristle picker rotates around an axis.

23. The device according to claim 15, wherein the bristle magazine includes a pusher adapted to apply pressure to a quantity of the filaments within the bristle magazine.

24. A device for manufacturing brushes comprising:

a bristle magazine having a feed chute comprised of guide walls for receiving filaments of precut length arranged in an array parallel to the guide walls, the feed chute having a discharge opening which is formed by the guide walls wherein the guide walls form arcuate shapes and taper essentially in the direction of the discharge opening; and a bristle picker bounding the discharge opening from outside, the bristle picker having at least one recess for receiving a predetermined quantity of the filaments;

wherein the thicknesses of the guide walls taper uniformly toward the discharge opening.

25. The device according to claim 24, wherein the arcuate shapes terminate at the discharge opening.

26. The device according to claim 24, wherein the discharge opening is arranged centrally to the feed chute and the arcuate shapes extend symmetrically to a longitudinal axis of the feed chute.

27. The device according to claim 24, wherein the discharge opening defines an orifice of variable cross section.

28. The device according to claim 24, wherein the discharge opening is shaped to conform to the size of the bristle tufts to be picked up by the bristle picker and is formed at a lowest position of the bristle magazine.

29. The device according to claim 24, wherein the at least one recess is groove-shaped.

30. The device according to claim 24, wherein the bristle picker is configured in a circular design.

31. The device according to claim 24, wherein the bristle picker rotates around an axis.

32. The device according to claim 24, wherein the bristle magazine includes a pusher adapted to apply pressure to a quantity of the filaments within the bristle magazine.

* * * * *